US007156248B2

(12) United States Patent
Christophe et al.

(10) Patent No.: US 7,156,248 B2
(45) Date of Patent: Jan. 2, 2007

(54) OVERCAP CLOSURES WITH ROLLED APRON

(75) Inventors: Philippe Christophe, Morangis (FR); Jacky Maugas, Ay (FR)

(73) Assignee: Pechiney Capsules, Clichy (FR)

( * ) Notice: Subject to any disclaimer, the term of this patent is extended or adjusted under 35 U.S.C. 154(b) by 265 days.

(21) Appl. No.: 10/311,341

(22) PCT Filed: Jul. 4, 2001

(86) PCT No.: PCT/FR01/02141

§ 371 (c)(1),
(2), (4) Date: Jan. 3, 2003

(87) PCT Pub. No.: WO02/02425

PCT Pub. Date: Jan. 10, 2002

(65) Prior Publication Data

US 2003/0183597 A1 Oct. 2, 2003

(30) Foreign Application Priority Data

Jul. 6, 2000 (FR) ..... 00 08805

(51) Int. Cl.

| | |
|---|---|
| ***B65D 39/00*** | (2006.01) |
| ***B65D 41/44*** | (2006.01) |
| ***B65D 41/58*** | (2006.01) |
| ***B65D 17/40*** | (2006.01) |
| *B65B 7/28* | (2006.01) |
| *B65B 61/18* | (2006.01) |
| *B67B 1/04* | (2006.01) |

(52) U.S. Cl. ..... 215/256; 215/232; 215/246; 215/364; 220/257.2; 220/276; 53/420; 53/471; 53/487; 53/489; 29/469.5

(58) Field of Classification Search ..... 215/251, 215/254, 274, 324, 364, 232, 246, 256, 277; 220/266, 270, 276, 257.1; 53/420, 471, 487, 53/489; 29/469.5; 426/122, 962; 493/257.2
See application file for complete search history.

(56) References Cited

U.S. PATENT DOCUMENTS 140,346 A * 7/1873 Chillingworth ..... 215/233

(Continued)

FOREIGN PATENT DOCUMENTS

CA 2119092 A * 9/1994

(Continued)

*Primary Examiner*—Nathan J. Newhouse
*Assistant Examiner*—James Smalley
(74) *Attorney, Agent, or Firm*—Dennison, Schultz & MacDonald

(57) ABSTRACT

Overcap (1, 11, 12) designed to overcap a neck (80) of a bottle (8) closed by a cork (82) containing a liquid to be packaged (83, 84) includes a rolled skirt (3) and a top (2) fixed to the rolled skirt around a circular junction area (4) common to the skirt and the top. The top is formed from a first strip of material chosen to have a nature and thickness so that it can be deformed, typically by stamping between a punch and a die or by thermoforming, to form a crease-free rim around the top. The rim is formed by the peripheral part of the top axially deformed over a height H between 1 and 5 mm, and the is a rim (20,21) that extends around an arc of a circle α varying from 45 to 90°. The rolled skirt includes an upper end (30) necked in over a width of at least 1 mm, cooperating with the rim to form the circular junction area, and is formed from a second strip of material (6) chosen such that the mechanical properties are not as good as the properties of the first material, the circular junction area (4) common to the rim (20, 21, 22) and to the upper end (30) extending over a width L equal to at least 0.5 mm.

21 Claims, 6 Drawing Sheets

U.S. PATENT DOCUMENTS 825,116 A * 7/1906 Engels ..... 53/478
1,280,255 A * 10/1918 Logan ..... 215/323
1,604,063 A * 10/1926 Miller ..... 215/251
1,647,489 A * 11/1927 Webster ..... 215/246
1,767,512 A * 6/1930 Cohoe ..... 215/246
1,882,359 A * 10/1932 Greenhouse ..... 215/251
1,982,567 A * 11/1934 Blanchard ..... 215/256
2,139,572 A * 12/1938 Booth ..... 53/488
2,161,097 A * 6/1939 Schroder-Nielsen ..... 215/307
2,194,147 A * 3/1940 Mauser ..... 220/257.1
2,562,423 A * 7/1951 Hood ..... 493/63
2,634,013 A * 4/1953 Atwood ..... 215/327
2,666,542 A * 1/1954 Price ..... 215/232
2,670,076 A * 2/1954 Monks ..... 206/516
3,232,469 A * 2/1966 Piazze ..... 215/251
3,243,070 A * 3/1966 Hoyle ..... 215/326
3,460,951 A * 8/1969 Heyl ..... 426/407
3,494,093 A * 2/1970 Downs et al. ..... 53/420
3,601,275 A * 8/1971 Lorieux ..... 215/326
3,746,201 A * 7/1973 Fujio ..... 215/246
3,809,365 A * 5/1974 Loffler ..... 215/253
3,827,591 A * 8/1974 Spelman et al. ..... 215/246
3,905,504 A * 9/1975 Stadler ..... 215/316
3,917,099 A * 11/1975 Lorieux ..... 215/277
3,924,771 A * 12/1975 Cleff ..... 215/246
3,933,266 A * 1/1976 Dautreppe et al. ..... 215/316
3,961,719 A * 6/1976 Pierlot et al. ..... 215/277
3,995,762 A * 12/1976 Pfefferkorn et al. ..... 215/256
4,093,095 A * 6/1978 Babiol ..... 215/307
4,294,367 A * 10/1981 Otsuka et al. ..... 215/246
4,356,222 A * 10/1982 Harakawa et al. ..... 428/78
4,390,552 A * 6/1983 Niwa ..... 426/126
4,391,383 A * 7/1983 Babiol ..... 215/256
4,452,842 A * 6/1984 Borges et al. ..... 428/195.1
4,525,154 A * 6/1985 Sauget ..... 493/154
4,583,656 A * 4/1986 MacLaughlin ..... 220/359.4
4,605,137 A * 8/1986 Taragna et al. ..... 215/254
4,947,627 A * 8/1990 Scheidegger ..... 53/557
5,012,942 A * 5/1991 Druesne et al. ..... 215/253
5,103,989 A * 4/1992 Druesne et al. ..... 215/254
5,172,460 A * 12/1992 Womack ..... 29/17.3
5,222,616 A * 6/1993 Druesne et al. ..... 215/256
5,230,427 A * 7/1993 Betts et al. ..... 206/213.1
5,555,988 A * 9/1996 Koch et al. ..... 215/249
5,603,422 A * 2/1997 Herrmann ..... 215/256
5,654,022 A * 8/1997 Sayre ..... 426/118
5,779,073 A * 7/1998 Milhomme ..... 215/232
5,992,658 A * 11/1999 Berger ..... 215/232
6,301,767 B1 * 10/2001 Granger et al. ..... 29/469.5
6,499,618 B1 * 12/2002 Leclerc et al. ..... 215/364
6,672,469 B1 * 1/2004 Hessbrueggen et al. .... 215/277

FOREIGN PATENT DOCUMENTS

EP 615915 9/1994
EP 1004517 5/2000
LU 80179 2/1979

* cited by examiner

OVERCAP CLOSURES WITH ROLLED APRON

FIELD OF THE INVENTION

This application is a filing under 35 USC 371 of PCT/FR01/02141, filed Jul. 4, 2001.

The invention relates to the field of overcaps for receptacles or bottles containing either a still liquid, typically red wine, or an effervescent liquid or a liquid under pressure, typically an effervescent wine or a champagne wine. In the latter case, the overcap is generally called a "sparkling wine overcap".

In all cases, the bottle is closed by a cork and the cork is covered by the said overcap for aesthetic reasons and/or to prove that it has not been tampered with. If the liquid is a wine under pressure, the cork is fixed to the bottle neck by a mechanical means, using a wire binder.

The invention is particularly applicable to overcaps with rolled skirts, that differ from overcaps formed by stamping from a metallic strip (typically tin or aluminium) or a metalloplastic strip.

DESCRIPTION OF THE RELATED ART

Different types of overcaps with rolled skirts are already known. These overcaps comprise a rolled skirt on which a seam is formed along a generating line, the upper end being closed by a top fixed to the said rolled skirt, typically by sealing with an adhesive.

In the case of overcaps designed for use as overcaps for bottles containing still liquids, these overcaps may be made either of a crimpable material, typically metallic or metalloplastic, or a heat shrinking plastic material, so that they can be fixed on the neck of a bottle comprising a glass ring, and cannot be removed with damaging or destroying the overcaps.

Different types of overcaps with rolled skirts are also known for overcaps for bottles containing effervescent liquids or liquids under pressure, as described in French patents applications No. 9815004, 9902322, 9907364 and 9907365 in the name of the applicant. These overcaps are typically made of a metallic or metalloplastic material and are creased and forced into contact with the neck of the bottle to be over capped.

Overcaps with rolled skirts are known to be more economic than stamped metallic overcaps. Therefore, developments have been carried out on them to attempt to obtain aesthetic and "handling" qualities similar to those particularly of stamped metallic overcaps, and at the present time the quality and price hierarchy varies from "high range" metallic overcaps to "low range" heat sealing overcaps, with rolled skirt overcaps typically made of metalloplastic material being intermediate between the two extremes.

Overcaps with rolled skirts according to the state of the art do not fully satisfy existing market requirements to the extent that:

- firstly there is a demand for improvements to the aesthetic qualities of rolled overcaps, particularly concerning the junction between the skirt and the top, such that the appearance of a rolled overcap should be more like the appearance of a stamped overcap, and particularly it is free of any creases.
- secondly, there is an increase in demand for customisation and increased differentiation between packaging products, including overcaps.

The invention is designed to solve these two problems simultaneously, so as to offer overcaps with an excellent aesthetic quality, typically including a top free of creases and differentiation means, particularly on the top of the overcap, without increasing production costs.

SUMMARY OF THE INVENTION

According to the invention, the overcap designed to cover a bottle neck closed by a cork containing a liquid to be packaged, comprises a: rolled skirt and a top fixed to the said rolled skirt, typically by gluing, around a circular junction area common to the said skirt and the said top and characterized in that:

a1) the said top is formed from a first strip of material chosen to have a nature and thickness so that it can be deformed, typically by stamping between a punch and a die or by thermoforming, to form a crease free rim around the said top, a2) the said rim is formed by the peripheral part of the said top axially deformed over a height H between 1 and 5 mm, a3) the said rim is a rim (20,21) that extends around an arc of a circle over an angle $\alpha$ varying from 45 to 90°, b1) the said rolled skirt comprises an upper end (30), necked in over a width of at least 1 mm, cooperating with the said rim to form the said circular junction area, b2) the rolled skirt (3) is formed from a second strip of material (6) with a nature and thickness chosen such that the mechanical properties are not as good as the properties of the first material (5), particularly so that the said top is not modified by any creases in the upper necked in end, b3) the upper necked in end (30) is a rounded end (31) in an arc of a circle over an angle $\beta$ varying from 45 to 90°, c1) the circular junction area (4) common to the rim (20, 21, 22) and to the upper end (30) extends over a width L equal to at least 0.5 mm, c2) the circular junction area (4) that comprises the part of the said top that covers the said necked in upper end (30,31), and typically the said rim (20,21), extends around at least an arc of a circle over an angle $\gamma$ varying form 30° to 90°.

Therefore, the invention is defined as being a combination of several essential means:

a) firstly, the material chosen to form the top must be capable of being stamped without creases being formed; it is actually a deformation, admittedly limited, but in the case of a first metallic or metalloplastic material, is done entirely between a punch and a die, in other words without a blank clamp. This deformation is a rim or a peripheral part of the said top axially deformed over a height H between 1 and 5 mm.

The applicant has observed that under these conditions, if this material is too thin, for example a 30 μm aluminium sheet, the sheet cannot be deformed without creasing or possibly tearing.

Furthermore, it would be pointless to use excessive thicknesses since it would unnecessarily increase the material cost.

In practice, the first step is to define a height H for the top which will control the appearance of the final overcap, and then for a given type of material, the minimum thickness of the material to give a top without creases is chosen by carrying out a selection test approximately reproducing the deformation of height H of the first strip of material.

In the case of a first metallic or metalloplastic material, this deformation is typically obtained by stamping without using a blank clamp, between a punch and a die, and in the case of a plastic material, typically by thermoforming.

Furthermore, those skilled in the art are well aware that they can obtain a given deformation in several passes, so that they may be able to obtain an uncreased top by carrying out a limited number of passes, typically between 2 and 4, while a top obtained in a single pass would have been slightly creased.

b) secondly, the said rolled skirt must comprise an upper end necked in over a width of at least 1 mm typically less than 5 mm, cooperating with the said rim around the said circular junction area, and the second material forming the skirt must be chosen with a nature and thickness as a function particularly of the first material. According to the invention, due to the difference in thickness and the mechanical properties between the first and the second materials, a second relatively thin material can be chosen and a rolled skirt can be formed in which the necked in part may form creases, provided that these creases are not themselves visible since they will be masked by the said crease free rim. Furthermore, these creases, if any, will not change the relief of the rim of the said top when the top is fixed onto the necked in part of the skirt, particularly taking account of the thickness or better mechanical properties of the material from which the said top is made. The hardness of the first material forming the top is typically equal to at least the hardness of the second material forming the skirt.

c) finally, the circular junction area, the area common to the said rim and the said upper end necked in by overlap, must extend over a width L equal to at least 1 mm typically less than 5 mm. Furthermore, it is important firstly that this overlap area should correspond to the part with the smallest radius of curvature of the said rim and the said necked in end, the rim of the top covering the said necked in upper end and completely masking any creases in the said necked in part, even if furthermore the width of the circular junction area can extend either towards the "flat" part of the top or towards the "cylindrical" or "tapered" part of the skirt.

Note that the invention can be used to make a relatively narrow circular junction area with width L, without deteriorating the integrity of the overcap throughout its life.

This combination of means can simultaneously solve the problems that arise, namely firstly an overcap with no creases at the junction strip or the connection strip between the rolled skirt and the top which makes overcaps according to the invention highly aesthetic, and secondly that it becomes possible to differentiate between overcaps by using different combinations of materials for the said first and the said second material, based on the information and selection criteria developed according to the invention.

Furthermore, the invention is capable of differentiating between materials forming the top and the skirt, particularly to reduce the cost of materials, since only the top is made of a relatively thick material, and the surface area of the top is relatively small compared with the skirt.

BRIEF DESCRIPTION OF THE DRAWINGS

All figures, except for FIG. 1, show aspects of the invention.

FIG. 2*a* is a partial section of the top along the vertical axis (10) showing that the rim (20, 21) extends around an angle or arc of a circle α over about 75°, whereas FIG. 2*b* is a complete section along the vertical axis (10) as shown in FIGS. 2*c* and 2*d*.

FIGS. 3*a* to 3*d* represent a partial section along the vertical axis (10) of the necked in upper end (30) of the rolled skirt (3), part (33) of which is creased after necking in.

In FIG. 3*a*, the necked in part consists of a rounded part (31) with a radius of curvature equal to R extending over an angle or arc of a circle β close to 45°, extending around an angle or arc of a circle close to 90° in FIGS. 3*b* and 3*c*, and in that the necked in part (31) also comprises a plane part (32) in FIG. 3*c*.

In FIG. 3*d*, the necked in part (30) is composed of a plane part (32).

In FIG. 4*a*, the circular common junction area (4) comprises a rounded part (41) extending over around an angle or arc of a circle γ close to 40°, the two radii of curvature R and R' having approximately the same centre of curvature, the difference R−R' being equal to approximately the thickness of the typically creased part (33).

FIG. 4*b* is similar to FIG. 4*a* with an angle or arc of circle γ close to 90° instead of 40°.

In FIG. 4*c* the circular common junction area (4) comprises a rounded part (41) with an angle or arc of a circle γ close to 60° and a linear part (42) towards the centre of the top (2), the assembly extending over a width L.

FIG. 4*d* represents the case in which the common circular junction area (4) is composed of a plane part (42) extending over a width L.

FIG. 5*a* is a side view of an overcap (1, 11) with a rolled skirt (3) and sealed edge (37), which comprises two lines of weakness (35) delimiting an initial opening tab (36), a destacking ring (34), an axial sealing area (37) to form the rolled skirt, and a circular junction area (4), these two areas not being visible from the outside and therefore shown in dashed lines.

FIG. 5*b* shows solid lines showing a sectional view along the vertical axis (10) of an overcap (1, 11) similar to that in FIG. 5*a*, placed before crimping on the neck (80) of a bottle (8) containing a still liquid (83), and closed by a cork (82), the neck comprising a glass ring (81). The crimped skirt (39) under the glass ring (81) is shown in dashed lines.

FIG. 6*a*, similar to FIG. 5*a* shows a side view of an overcap (1, 12) comprising two lines of weakness (35) that delimit an initial opening tab (36), the skirt (3) of the overcap comprising grooves (38).

FIG. 6*b* shows a perspective view of the neck (80) of a bottle (8) of champagne (84), the first time that it is opened, the cork (82) in this case being fixed to the neck by a wire fastener (85).

FIG. 6*c* illustrates the shape of the top (2) of the overcap, characterized particularly by its small radius of curvature $R_1$ and its large radius of curvature $R_3$.

FIG. 8 shows the process in which the blank top or disk (50) is cut out at position "C" before being simultaneously shaped and fixed to the skirt at position "D".

FIG. 9 shows the process in which the first strip of material is shaped, the strip being shaped (52) then cut out at position "C" to form a top blank (53), this blank being fixed to the rolled skirt at position "D", and complementary shaping designed to round the top being done at position "F" shown diagrammatically in FIG. 11.

FIG. 10 shows the process in which the first strip of material is a plastic material shaped by thermoforming in three passes, the strip being shaped (52) then cut out at position "C" to form a top (2) typically at the final dimensions that will be fixed to the rolled skirt at position "D".

DETAILED DESCRIPTION OF THE INVENTION

Figure 2B:
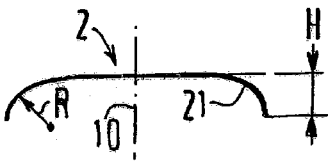
FIGS. 2*a* and 2*b* illustrate an embodiment of the top (2) in which the rim (20) of the top forms a rounded edge (21) with a radius of curvature R and axial height H measured parallel to the centre line (10) of symmetry of the top (2) or the overcap (1).

According to a first embodiment of the overcap according to the invention:

a) the said rim (20, 21) of the top (2) has a radius of curvature R between 1 mm and 5 mm, b) the necked in upper end (30) has a radius of curvature R' equal to approximately R minus the thickness of the said end, The top necked in end (30) usually comprises all or part of a creased part (33), possibly taking account of the necking in and the mechanical properties of the second material.

Figure 2D:
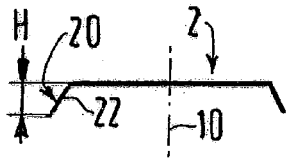
FIG. 2*d* illustrates another embodiment of the top (2) in which the rim (20) is a plane edge (22).
Figure 2C:
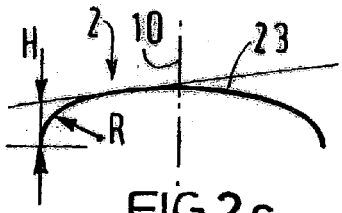
FIG. 2*c* illustrates another embodiment of the top (2) in which the central part (23) of the top is convex, instead of being approximately plane as in FIGS. 2*a* to 2*c*.

Preferably, the said arc of circle $\alpha$ extends from 55 to 80°, such that the rim (2, 21) of the top (2) forms at least 50% of the curvature or slope change between the top (2) and the skirt (3), this slope change $\delta$ being close to 90° and slightly less than 90° in the case of truncated overcaps (see FIG. 5*b*) or convex top overcaps as in FIG. 2*c*.

Figure 3A:
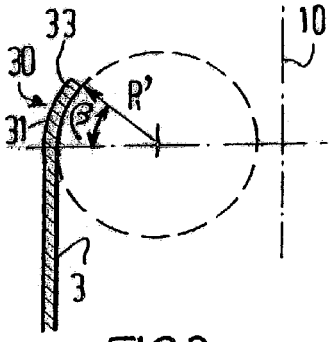
Figure 3B:
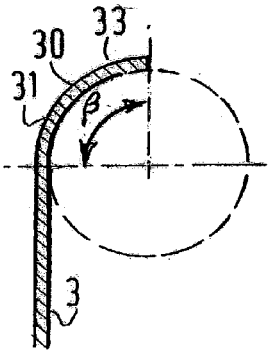
Figures 3C, 3D:
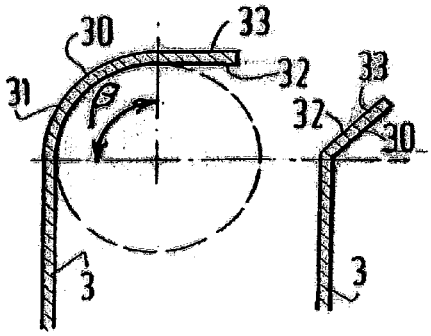
Figure 4A:
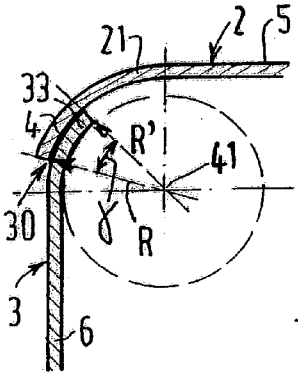
FIGS. 4*a* to 4*d* diagrammatically show the circular area (4) of the junction common to the said skirt and the said top, the necked in upper ends (30) being as shown in FIGS. 3*a* to 3*d*.
Figure 4B:
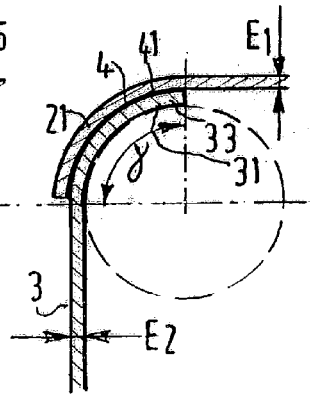
Figure 4C:
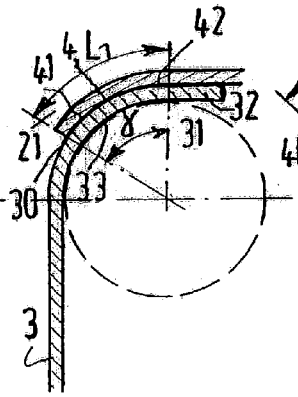
Figure 4D:
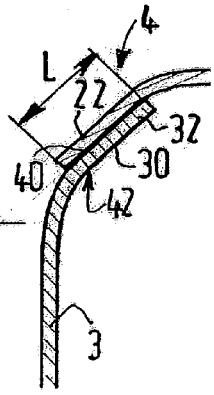

According to another embodiment of the invention, the rim (20) may consist of a plane rim (22) in which the upper end (30) has a plane end (32) and in which the circular area (4) is a non rounded or plane area (42) like that shown in FIGS. 2*d*, 3*d* and 4*d*. This plane end usually comprises a creased part (33) taking account of the necking in of the blank of the skirt (62).

Furthermore, as illustrated in FIGS. 3*c* and 4*c*, the upper necked in end may comprise a rounded part prolonged by a plane part as illustrated in FIG. 3*c*, the junction area (4) then possibly including a plane part (42) like that shown in FIG. 4*c*. These rounded and plane parts are usually also creased.

According to the invention, the width L of the circular junction area (4) may vary from 1 mm to 5 mm, typically from 1 mm to 3 mm in the case of overcaps for still wines and 2 to 5 mm in the case of overcaps for wine under pressures, regardless of the shape (rounded and/or plane) of this area. This relatively narrow width is sufficient to fix the top (2) on the upper necked in end (30) of the skirt (3).

As already mentioned, the rolled skirt (3) is formed from a second strip of material (6), the nature and thickness of which are chosen such that the mechanical characteristics are weaker than the properties of the first material (5), particularly such that the said top is not deteriorated by any creases in the necked in upper end. This may be achieved by making the thickness $E_1$ of the first strip of material (5) greater than the thickness $E_2$ of the second strip of material (6), and/or ensuring that the intrinsic mechanical properties of the first strip of material (5) are higher than the properties of the second strip of material (6). See FIG. 4*b*.

Several cases can arise:

a) either the top and the skirt are composed of the same material, in this case it is sufficient to choose a thickness $E_1$ of the first strip of material (5) forming the top sufficient to form a crease free top, and thicker than the thickness $E_2$ of the second strip of material (6) forming the skirt, where the thickness $E_2$ is typically between 0.4 and 0.8 times $E_1$, b) or the top and the skirt are composed of different materials, the thickness $E_1$ of the first strip of material is then always determined by the formation of the top without creases, and the thickness $E_2$ of the second strip of material (6) forming the skirt is not directly correlated to the thickness $E_1$ and is chosen to be as thin as possible compatible with normal requirements in the industry.

According to a first variant of the invention, the first strip of material (5) forming the top (2) may be a metallic strip typically made of aluminium or aluminium or tin alloy between 40 and 120 μm thick, and typically between 70 and 90 μm.

According to a second variant of the invention, the first strip of material (5) forming the top (2) may be a strip of metalloplastic material with an Al/PO/Al or Al/PO structure, where PO denotes a layer of polyolefin, typically PE, and Al denotes an aluminium or aluminium alloy layer, the thickness of the PO layer being between 10 and 80 μm the thickness of the Al layer being between 10 and 60 μm, and the thickness of the said strip being between 30 and 120 μm.

According to a third variant of the invention, the first strip of material (5) forming the top (2) may be a plastic strip of material, typically polyolefin, between 40 to 200 μm thick, and typically between 70 and 150 μm. The said plastic material may be a transparent, colourless or coloured plastic material such that the cork can be seen, with the accompanying advantages for the consumer. For still liquids such as red wines, it may be useful to see the condition of the cork and to see if there were any leaks. For liquids under pressure such as champagne, it may be useful to see the metallic plate covering the cork and over which the wire fastener is placed, and these corks or metallic plates may be suitable for making collections.

The second strip of material (6) forming the skirt (3) may be chosen from among crimpable or placeable or fold down metallic or metalloplastic materials, or among films of heat shrinking plastic materials.

As already mentioned, crimpable or heat shrinking materials with rolled skirts are used to form overcaps for bottles containing still wines, whereas placeable and fold down materials are used to form overcaps for sparkling wine or wine under pressure.

When a metalloplastic material is used, this metalloplastic material may be a multi-layer material with an Al/PO/Al or Al/PO structure in which PO denotes a layer of polyolefin, typically PE, and Al denotes an aluminium or aluminium alloy layer.

Furthermore, the PO layer may bond to the Al layer, either by using a PO layer comprising carboxylic acid or carboxylic anhydride functions, or a complementary adhesive layer between the PO and Al layers, or due to surface treatments of the PO and/or Al layers that will promote this adhesion.

The thickness of the PO layer may be between 10 and 80 μm, and the thickness of the Al layer may be between 10 and 50 μm, the total thickness of the corresponding multi-layer material may be between 20 μm and 100 μm.

A first specific purpose of the invention consists of an overcap (11) in which the rolled skirt (3) is a skirt made of a crimpable or heat shrinking material, so as to form an overcap (11) for receptacles containing still liquids.

A second specific purpose of the invention consists of an overcap (12) in which the rolled skirt is a skirt made of a placeable and fold down material, so as to form an overcap (12) for receptacles containing liquids under pressure, typically champagne and sparkling wines.

Figure 5B:
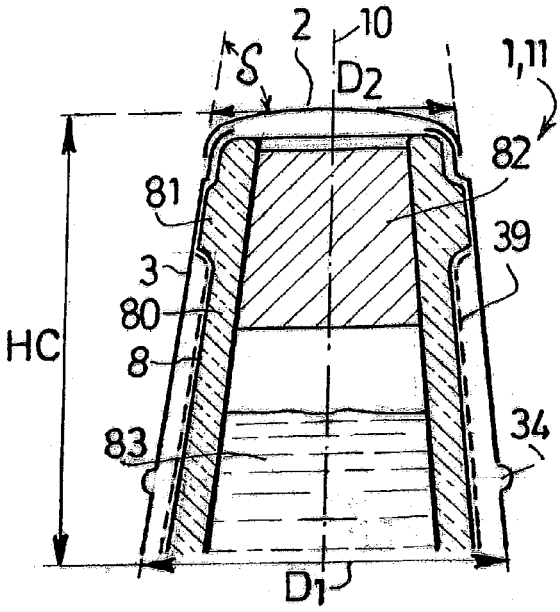
FIGS. 5*a* to 5*b* relate to overcaps (1, 11) for bottles (8) closed by a cork (82) and containing a still liquid (83).
Figure 5A:
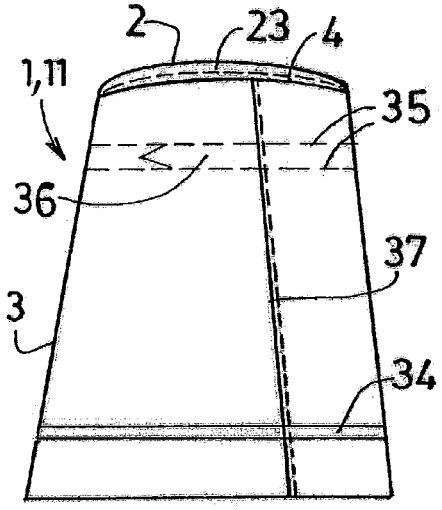
Figure 6B:
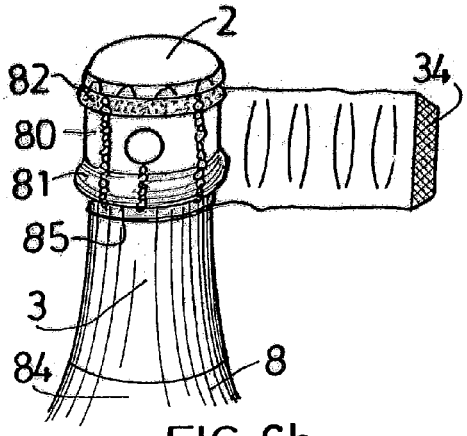
FIGS. 6*a* to 6*c* show overcaps (1, 12) for bottles (8) containing a sparkling wine or a wine under pressure (84).
Figure 6A:
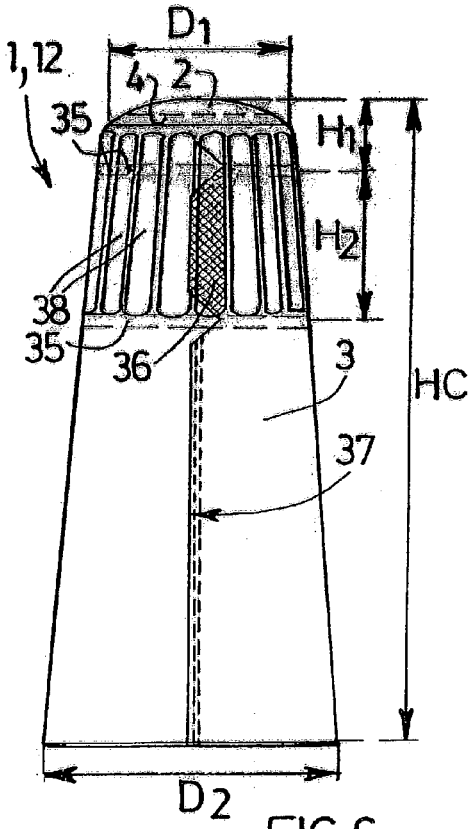

The overcap (1) according to the invention may comprise easy opening means (35, 36) like those shown in FIGS. 6*a* and 6*b* for an overcap, and diagrammatically in FIG. 5*a* in the case of an overcap for still wines.

Overcaps (1) according to the invention typically have a tapered skirt, to facilitate stacking of the said overcaps, mainly in the case of overcaps (11) for still wines, they may be provided with a continuous or interrupted circular ring (34) on the skirt, so as to control the said stack of the said capsules (1, 11) and to facilitate unstacking them. The overcaps (1, 11) in FIGS. 5*a* and 5*b* comprise a circular and continuous ring (34).

Another purpose of the invention consists of a process for manufacturing overcaps (1, 10, 11) according to the invention, in which:

a) the said first (5) and the second (6) strips of materials are typically in the form of a very long reel, b) a blank (60) is cut from the strip (6) of the second material, a line of adhesive (61) is placed on one side of the edges (600) of the blank (60), and the blank (60) is rolled on a punch (70) so as to apply the other side edge of the blank on the said line of adhesive and thus form a blank of the skirt (62), the upper end of which projects beyond the end of the said punch, c) a first die (71) with the required shape adapted to the shape of the said mandrel, or any other equivalent means, typically a crimping top with rollers or wheels, is applied to the end of the said punch (70) so, as to form a skirt (3) with a necked in upper end (31), d) a disk (50) with a predetermined diameter is cut out in the strip (5) of the first material, e) the said top (2) is shaped and, f) it is fixed to the skirt (3) by placing either the said top blank (50) or the said top formed between the said necked in upper end (30) and a second die (72), and compressing it on the necked in upper end (31) using the second die (72) so as to form the circular junction area (4), after placing adhesive on the top blank (50) or on the necked in upper end (30), either in the form of a circular adhesive line (40) or over all or part of the surface of the said first material.

A certain number of modifications or variants to this process are possible. Thus in step e) in the process, the said top (2) may be formed before being fixed to the skirt (3) by one or several shaping passes. This variant was illustrated in FIG. 10, typically in the case in which the first material is a plastic material and in which the top is formed by thermoforming, but it would also be useable in the case in which a large deformation has to be made to the top and it needs to be made in several stamping passes of a metallic or metalloplastic material, but always without a blank clamp, particularly taking account of the need for compact shaping equipment.

Figure 10:
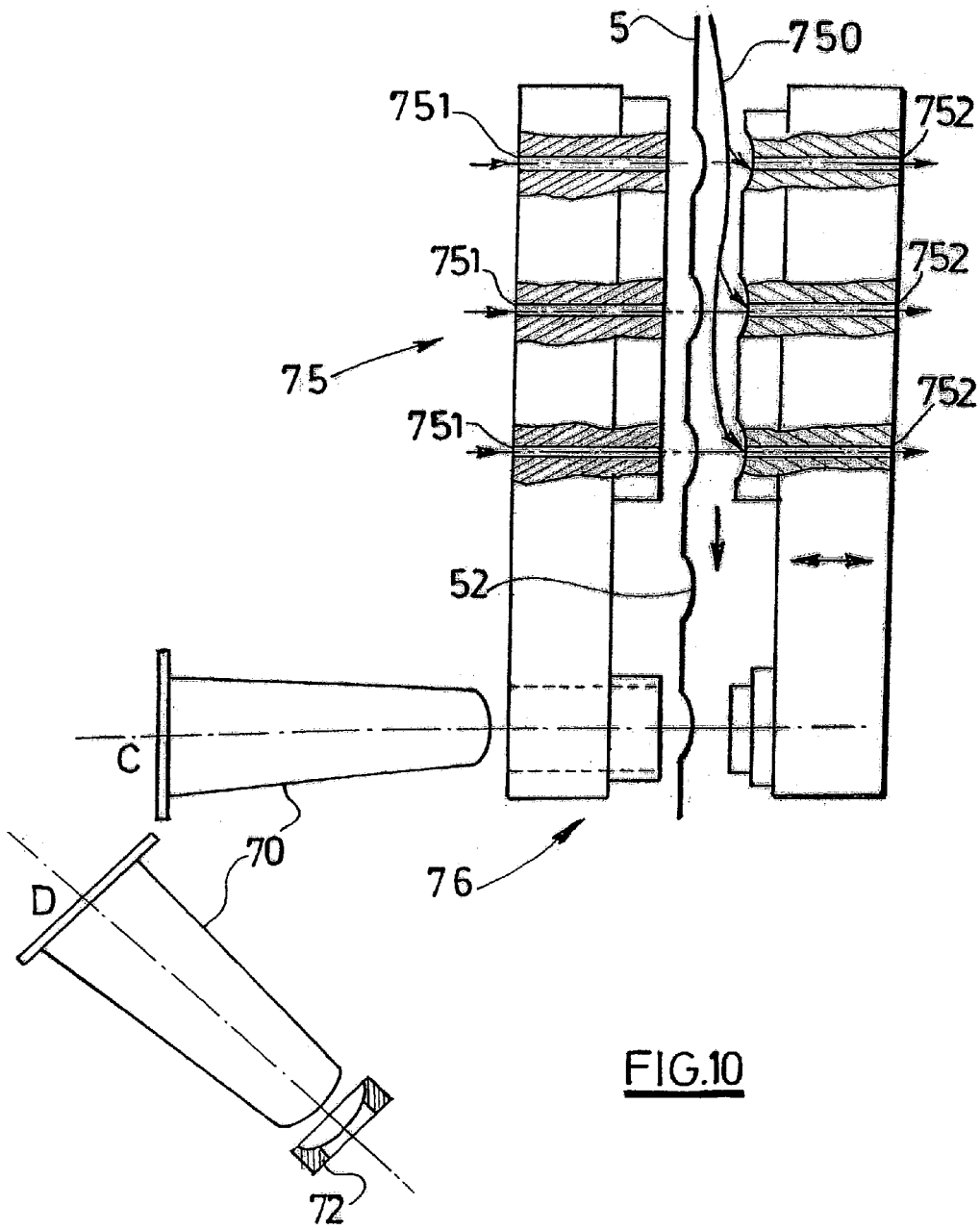

In the process modification illustrated in FIG. 10, the shaping tool (75) comprises three dies or thermoforming cavities (750), each provided with a central suction duct (752), with a hot air inlet (751) on each side of the strip to be deformed (5), intended particularly to increase the temperature of the strip (5) to the thermoforming temperature. In this case, the top (2) obtained by thermoforming is at its final dimensions.

See also the second series in the second series of examples for overcaps with transparent tops.

Concerning the attachment of the top (2) to the rolled skirt (3) by an adhesive means, an adhesive sealing layer (usually heat sealing) may be deposited, preferably on the disk or on the first material before the disk is cut, rather than on the top necked in end (30) of the rolled skirt (3).

If it is deposited on the first material, the entire inner surface of the first material may be covered by application of a hot-stick varnish or a hot-melt glue or resin, either by coating or extrusion or any other known method. If the first material is a thermoplastic, it would be possible to form the said first material coated with an adhesive hot-melt adhesive coat directly by coextrusion. If the first material is a plastic, the adhesive coat is preferably chosen to be as light or as transparent as possible to make the top as transparent as possible.

In the case of an adhesive deposit on the top itself, it is possible to have a circular sealing adhesive line forming a marked deposit, applied such that this deposit does not affect the transparency of the visible part of the top.

Figure 9:
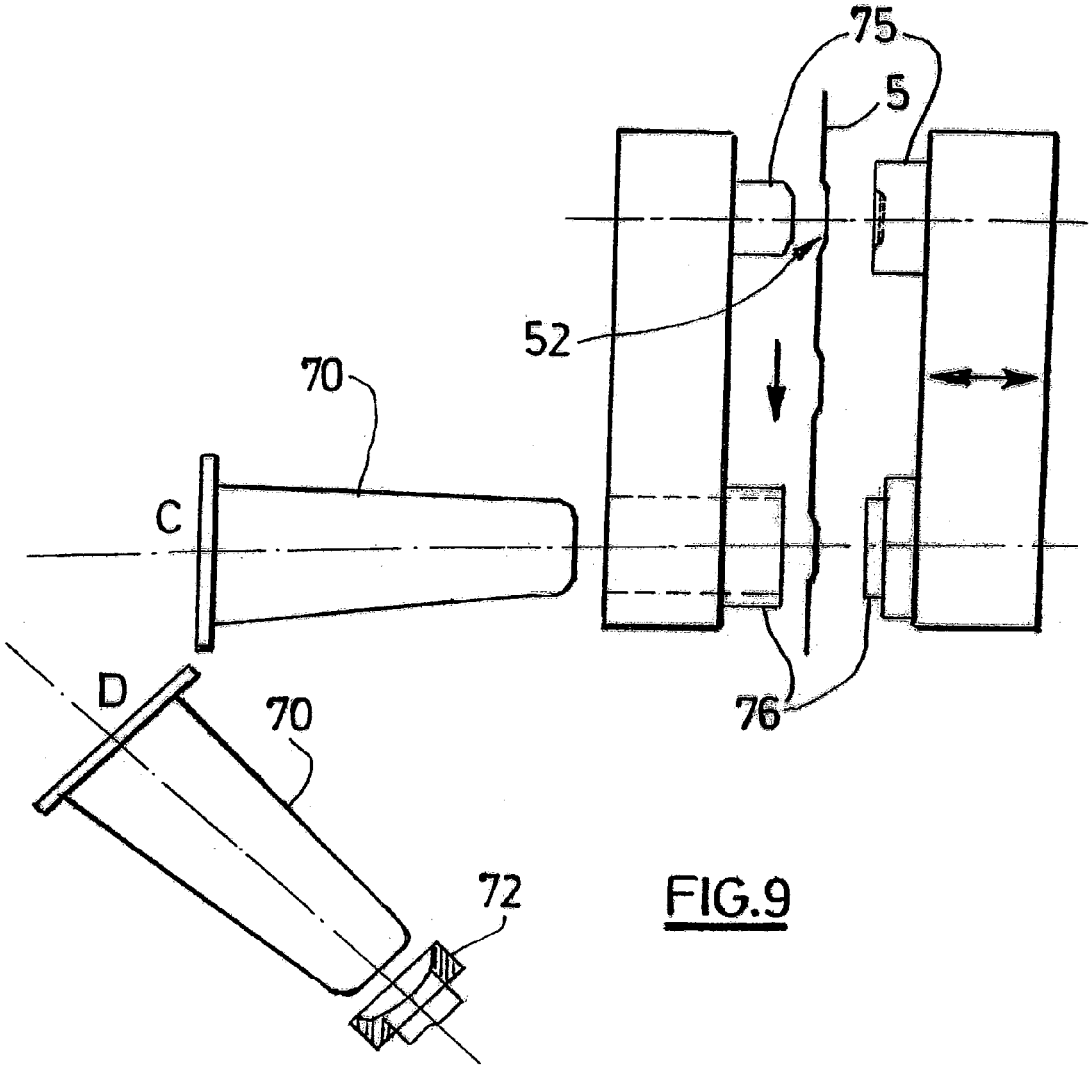

According to a first variant of the process, the order of the previous cutting d) and shaping e) operations may be inverted, the strip (5) being shaped first, and the part of the shaped strip then being cut out, before being fixed to the skirt in step f) as illustrated in FIGS. 9 and 10.

Figure 7:
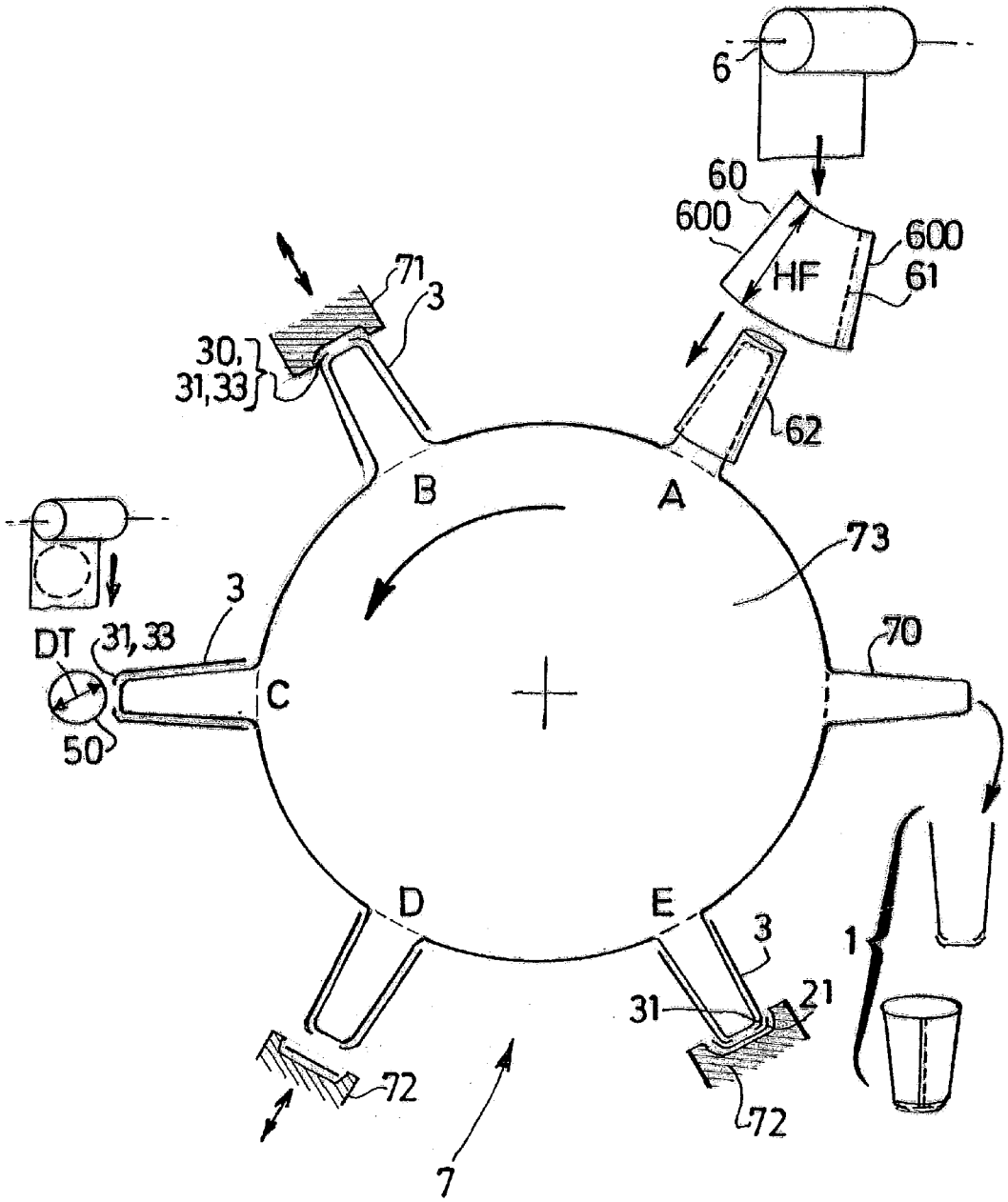
FIG. 7 is a diagrammatic top view of a device for the production (7) of overcaps including a carrousel or a turret with 6 positions denoted from A to F.
Figure 8:
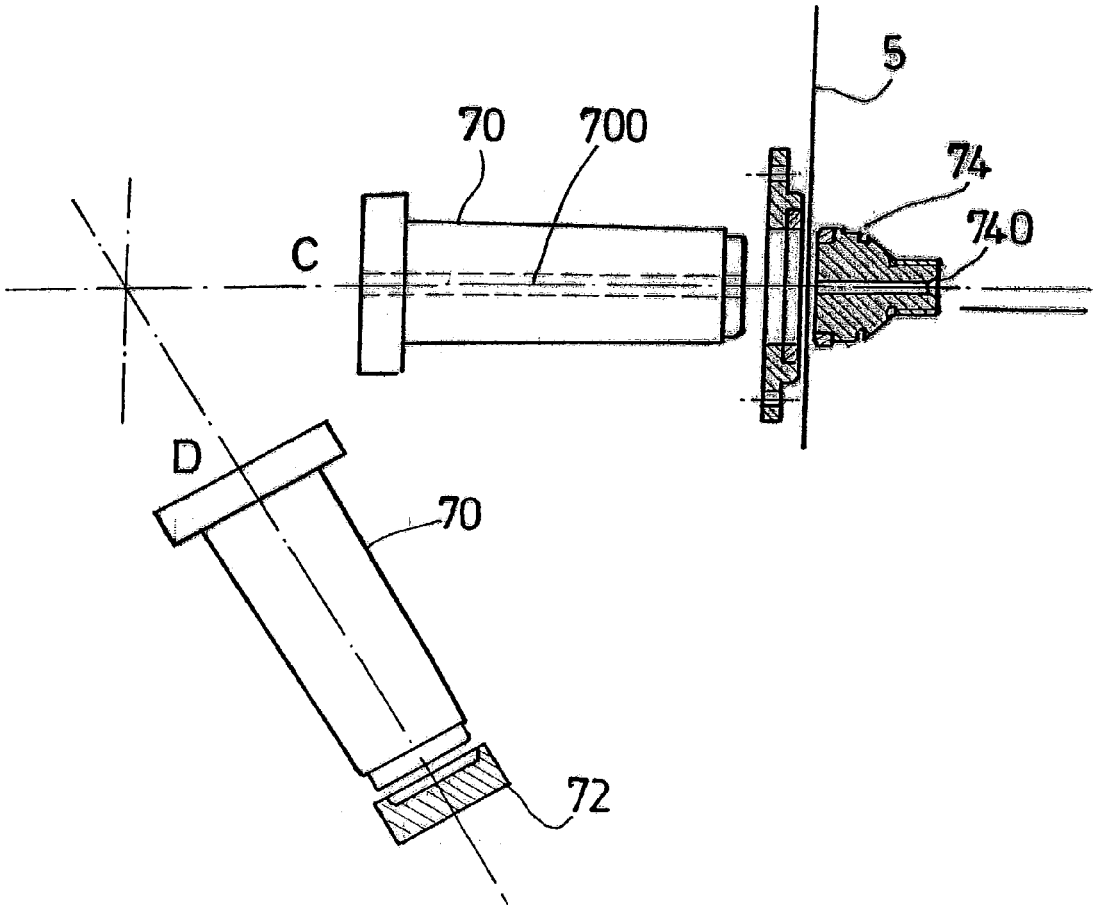
FIGS. 8 to 11 are partial sectional views in the horizontal plane of elements of the overcap production device (7) according to different variants of the process.

According to a second variant of the process, the previous steps e) for shaping and f) attachment may be combined into a single step, the top (2) being formed when it is attached to the skirt (3) as illustrated in FIGS. 7 and 8. See also the first series of tests in the first series of examples.

This process was illustrated diagrammatically by the device (7) in FIG. 7 that shows a carrousel (73) with 6 positions denoted "A" to "F" as a top view:

- position A: rolling of the blank (60) cut out from a strip of the said second material (6), after depositing an adhesive line (61) and the formation of a skirt blank (62) on the punch, at the end of the blank projecting beyond the punch,
- position B: formation of the necked in upper end (30) by compression using a first die (71), this end then generally being rounded (31) and creased (33), the creases possibly being "crushed" by this compression,
- position C: a disk (50) is formed, cut out from a strip of the said first material,
- position D: the disk (50) is heat sealed onto the skirt (3), the disk (50) being placed between a second die (72) and the necked in upper end (30) already formed in the previous position, so as to form a top (2) and to fix it simultaneously to the skirt (3), typically either using an adhesive layer present on the inside face of the first material, or a circular adhesive line deposited on the disk (50) in a marked manner, the adhesive typically being a hot-melt type glue, or a hot-stick type of varnish,
- position E: the top (2) is compressed on the necked in upper end (30),
- position F: the overcap (1) is ejected.

Figure 6C:
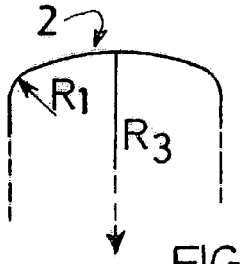
Figure 11:
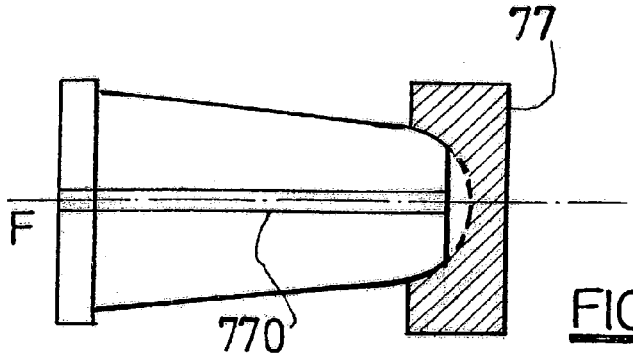

According to another variant of the process, after step f) for attachment of the top to the skirt, the shaping of the top, typically the central part (23) of the top, can be completed as illustrated in FIG. 11 that is complementary to FIG. 9. In the case of overcaps, it may be preferable to round the central part (23) of the top at the end of the process to apply a radius of curvature $R_3$ to it (see FIG. 6*c*), after having kept it plane particularly to mark it in relief. See also the first series of tests in the second series of examples for overcaps.

Regardless of which variant of the process is used, the overcap formed may be finished off, for example decorated by hot marking, or it may be provided with easy opening means, typically a first opening tab (36) delimited by two lines of weakness (35) using means not shown in FIG. 7.

Depending on their nature, these finishing steps may be done either on the first and/or on the second strip of material, or during the overcap manufacturing process, or reworking after the overcap has been manufactured.

In the process according to the invention, the punch (70) may comprise a top with an embossed or recessed pattern, and/or the second die (72) may be provided with an embossed or recessed pattern in order to form the said embossed or recessed pattern on the top (2) of the overcap during formation and attachment of the top to the skirt.

The overcaps (12) may also comprise decorative elements located under the skirt in two distinct parts, as is done for champagne bottles. In this case, the blank (60) is cut out accordingly and comprises the said decorative element.

EXAMPLE EMBODIMENTS

The first example was for overcaps for still wines (first series of examples) and overcaps for champagne (second series of examples).

In each case, the first strip of material (5) used was either a metalloplastic material (first series of tests) made of Al/PE/Al, or a transparent plastic material (second series of tests) made of PE.

The said first metalloplastic materials used in the first series of tests were selected, particularly in terms of their thickness, using a laboratory test in which a disk or part of the strip to be tested was compressed between a punch and a die with the same geometric shape as the punch (70) and the die (72) on the production line, and in particular the thickness at which creases were no longer formed was observed, knowing that this deformation is made without a blank clamp.

For a first plastic material, the strip of plastic material is thermoformed in one, two or three passes, and the appearance of the shaped top is observed. The selected thickness must be such that the top has no creases and the mechanical properties are sufficiently good and/or the top is thick enough such that when the top is compressed on the upper necked in end (30) of the skirt, the creases in this necked in part do not mark the rim (20) of the top (2) sufficiently to make them visible from the outside.

First Series of Examples

Overcaps (11) for still wines were made using the process according to this invention, similar to those shown in FIGS. 5*a* and 5*b*.

These overcaps (11) have the following dimensions:

diameter $D_1$ of the bottom of the skirt: 31.16 mm diameter $D_2$ of the top: 29.5 mm height HC: 50 mm.

Figure 2A:
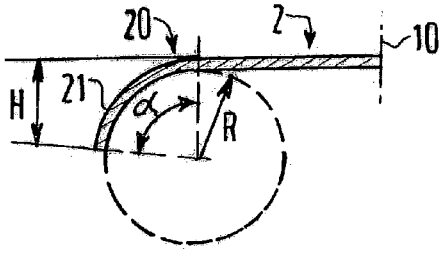
Figure 1:
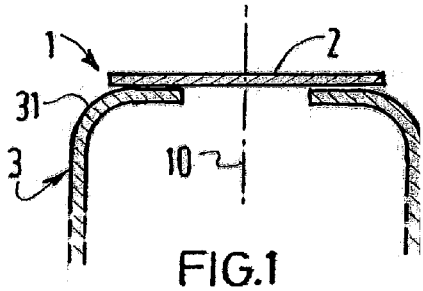
FIG. 1 is a partial section along the vertical axis (10) of an overcap (1) according to the state of the art, the rolled skirt (3) comprising an upper creased part (31) which is largely visible.

In these overcaps, all angles α, β and γ were equal to 80° ±5° as shown in FIGS. 2*a*, 3*b* and 4*b*, with width L equal to 2.5 mm, the radius of curvature $R_1$ being equal to 2 mm and the height H being equal to 1.8 mm.

In these overcaps, the starting point was a developed shape of the skirt (60) with height HF equal to 50.6 mm.

The following materials were chosen in a first series of tests:

first strip material (5) to form the top: 80 μm aluminium in the 1000 series (or the 8000 series: depending on the tests) according to the Aluminium Association designation, having observed that this thickness of aluminium was capable of conforming between the punch and a die with the same radius of curvature equal to approximately 2 mm, without the formation of creases or alteration of material, this strip of material having been coated with a hot-melt layer on one face, second strip of material (4) to form the skirt: metalloplastic material Al/PE/Al, where Al represents a layer or sheet of aluminium in the 1000 or 8000 series with a thickness of 20 μm, and PE is a 40 μm thick polyethylene layer.

In this first series of tests, the carrousel (7) or the forming turret comprises 6 punches (70), or 6 stations or positions marked A to F as shown in FIG. 7:

A: cut out of the developed shape of a skirt (60) from a reel of second material (6) and the formation of a rolled skirt blank (62) after removing a line of adhesive (61), B: folding of the end of the blank (62) to obtain a skirt (3) with a rounded end (31) generally creased (33), by the action of a rounded die (71), C: cut out a disk (50) with a diameter DT equal to 31 mm, D: heat sealing of the top blank (50) on the rounded end (31) of the skirt (3), using a heated rounded die (72) to form a top (2) sealed to the skirt (3), E: press the top (2) onto the rounded end (31) of the skirt (3) to finish shaping of the top using a rounded die (72'), all rounded dies (71, 72, 72') having a radius of curvature equal to approximately 2 mm, F: eject the overcap (1).

FIG. 8 diagrammatically shows positions C and D, with the cut-out of the strip of the first material (5) at the C position using a cutting device (74), the cut-out disk or the top blank (50) being transferred to the end of the punch covered by the skirt (3) (not shown in FIG. 8) and held in position before attachment particularly using suction ducts (700) or (740) creating a vacuum and with attachment of the disk (50) on the skirt (3) by heat sealing, due to the heating rounded die (72).

The following materials were chosen in a second series of tests:

first strip of material (5) to form the top: 120 μm thick transparent PVC, after observing that this thickness of PVC was conform without the formation of any creases and without any deterioration of the material. Transparent strip PVC was used coated with transparent hot-melt type glue on one face, second strip of material (4) to form the skirt: Al/PE/Al metalloplastic material identical to that used in the first series of tests.

The first step in this second series of tests was to form the strip (5) by thermoforming using a shaping tool (75), in the same way as illustrated in FIG. 10 for the second series of tests of the second series of examples given below. The portion of the deformed strip (52) that has the final dimensions of the top (2) was then cut out using a cutting tool (76), and the top obtained was then fixed to the rolled skirt (3), a transparent heat sealing varnish having firstly been deposited on the inside face of the strip (5) or the top (2) depending on the tests.

Second Series of Examples

Overcaps (12) were made for wines under pressure (champagne) using the process according to this invention.

The dimensions of these overcaps (12) were as follows:

diameter $D_2$ of the bottom of the skirt: 51.6 mm diameter $D_1$ of the top: 34 mm height HC: 122 mm In these overcaps, all angles α, β and γ were equal to 80° ±5° as shown in FIGS. 2*a*, 3*b* and 4*b*, with width L equal to 5 mm, and the height H being equal to 3.6 mm.

The radii of curvature $R_1$ and $R_3$ (see FIG. 6*c*) were assumed to be equal to 4 mm and 30 mm respectively.

The diameter of the top blank (50) was 36 mm and the height of the skirt blank (60) HF was equal to 119 mm.

In a first series of tests, the following materials were chosen:

first strip of material (5) to form the top: aluminium 80 μm (reference AA: series 100 or 8000 depending on the tests) after observing that this aluminium thickness was capable of conforming without the formation of creases or deterioration to the material, this strip of material having been coated on one face with a coat of hot-melt varnish, second strip of material (4) to form the skirt: Al/PE/Al metalloplastic material, where Al represents a layer or sheet of aluminium (reference AA: series 1000 or 8000 depending on the tests), with thickness 20 μm, and PE a 40 μm thick coat of polyethylene.

These overcaps were made using a forming carrousel or turret (7) with 9 positions, A: formation of the rolled skirt blank (62), B: bending of the end of the blank (62) to obtain a skirt (3) with a rounded end (31), generally pleated (33), by the action of a rounded die (71), B1: complementary compression of the rounded part (31), C: the strip (5) of the first material was preformed as shown in FIG. 9, the preformed strip (52): having a rounded edge with a radius of curvature $R_1$ equal to 4 mm, and a plane central part, and a plane top (2) was then cut out, D: the plane top (2) was heat sealed and possibly relief was formed on the top, E: hot marking of the top was applied, and grooves (38) were formed, F: the final shaping of the top was finished as shown in FIG. 11, by blowing air inside the overcap to round out the plane central part of the top as shown in FIG. 11, to apply a radius of curvature $R_3$ to it, equal to 40 mm.

In a second series of tests, the following materials were chosen:

first strip of material (5) to form the top: 120 μm thick transparent PVC, after observing that this thickness of PVC conforms without the formation of creases or any deterioration to the material.

Furthermore, as in the second series of tests in the first series of examples, a transparent hot-melt varnish was deposited on the disk or on the first material before cutting it into disks, on the inside face of the strip (5) or the top (2), according to the tests, second strip of material (4) to form the skirt: Al/PE/Al metalloplastic material identical to that for the first series of tests.

The process according to this second series of tests is different from the process for the first series of tests in that at position C, the strip was heat sealed by applying it by passing it in a mould under the action of hot air to form the top in three passes before cutting, as illustrated diagrammatically in FIG. 10, and in that station F was deleted, with the top having its final shape after thermoforming at position C.

The results of these tests: all overcaps (1, 11, 12) obtained have a crease free fillet connection between the skirt and top.

Consumer evaluation tests for still wines have shown that consumer perception of this type of overcaps (11), placed them approximately equivalent to stamped metallic overcaps, much better than the traditional rounded skirt capsules in which the creases of the upper end of the skirt are visible.

Similarly, in the case of overcaps for champagne wines, the overcaps according to the invention were more attractive than conventional overcaps in which creases formed by the upper end of the skirt can be seen, at the top.

ADVANTAGES OF THE INVENTION

The invention has three sorts of advantages, without changing normal production rates:

firstly, it can be used to make rolled overcaps, and therefore relatively economic, which have an appearance very similar to the appearance of stamped overcaps, to the extent that the means according to the invention can avoid the formation of creases at the junction between the top and skirt, and in that the top comprises a rim with a strong curvature, while keeping the same production rates as for traditional production lines, secondly, it can be used to manufacture a complete variety of overcaps with all sorts of materials, once these materials have been selected in a laboratory test, and very easy to change, so that even relatively short series of a few tens of thousand of overcaps can be made cost effectively, finally, it can reduce the material cost and the weight of overcaps by about 5%, the formation of a top with a material with relatively "high" mechanical properties making it possible to choose a material for the skirt with slightly lower mechanical properties than is possible for skirts according to prior art, the global balance being positive considering the fact that the area of the skirt is at least 6 times greater than the area of the top in the case of the overcaps (11) in the first series of examples, and at least 15 times greater than the area of the top in the case of overcaps (12) in the second series of tests.

List of marks

| | |
|---|---|
| Overcap | 1 |
| Overcap centre line | 10 |
| Overcap for still wine | 11 |
| Overcap for sparkling wine | 12 |
| Top | 2 |
| Top rim | 20 |
| Rounded edge | 21 |
| Plane edge | 22 |
| Central part | 23 |
| Rolled skirt | 3 |
| Necked in upper end | 30 |
| Rounded part | 31 |
| Plane part | 32 |
| Folded part | 33 |
| Destacking ring | 34 |
| Lines of weakness | 35 |
| First opening tab | 36 |

-continued

| List of marks | |
|---|---|
| Axial sealing area | 37 |
| Grooves | 38 |
| Crimped skirt | 39 |
| Circular junction area | 4 |
| Circular adhesive layer | 40 |
| Rounded part | 41 |
| Plane part | 42 |
| Reel or strip of first material | 5 |
| Disk | 50 |
| Circular adhesive line | 51 |
| Deformed strip | 52 |
| Reel or strip of second material | 6 |
| Skirt developed shape | 60 |
| Side edges | 600 |
| Line along cone generating line | 61 |
| Skirt blank | 62 |
| Device or production line | 7 |
| Punch | 70 |
| Suction duct | 700 |
| First necked in die | 71 |
| Second attachment die | 72 |
| Carrousel | 73 |
| Disk cut-out assembly | 74 |
| Suction duct | 740 |
| Shaping tools | 75 |
| Cavity or die | 750 |
| Hot air inlet | 751 |
| Vacuum/suction duct | 752 |
| Cutting tools | 76 |
| Third die | 77 |
| Compressed air transfer duct | 770 |
| Bottle | 8 |
| Neck | 80 |
| Glass ring | 81 |
| Cork | 82 |
| Still liquid | 83 |
| Liquid under pressure | 84 |
| Wire fastener | 85 |

The invention claimed is:

1. Overcap (1, 11, 12) designed to overcap a neck (80) of a bottle (8) closed by a cork (82) containing a liquid to be packaged (83, 84), comprising a rolled skirt (3) and a top (2) fixed to the rolled skirt around a circular junction area (4) common to the skirt and the top, wherein:

a1) the top is formed from a first strip of material chosen to have a nature and thickness so that it can be deformed to form a crease free rim around the top, a2) the rim is formed by the peripheral part of a top axially deformed over a height H between 1 and 5 mm thereby forming a terminal end of the rim, a3) the rim extends around an arc of a circle α varying from 45 to 90°, b1) the rolled skirt comprises an upper end (30) necked in over a width of at least 1 mm, cooperating with the rim to form the circular junction area, b2) the rolled skirt (3) is formed from a second strip of material (6) of lesser mechanical strength than the first strip of material and selected such that the top is not modified by any creases in the upper necked in end, b3) the upper necked in end (30) is a rounded end (31) in an arc of a circle β varying from 45 to 90°, c1) the circular junction area (4) common to the rim (20, 21, 22) and to the upper end (30) extends over a width L equal to at least 0.5 mm, and c2) the circular junction area (4) that comprises the part of the top that covers the necked in upper end (30, 31), extends around at least an arc of a circle γ varying from 30° to 90°.

2. Overcap according to claim 1 wherein:

a) the radius of curvature R of the rim (20, 21) of the top (2) is between 1 mm and 5 mm, and b) the top necked in end (30) has a radius of curvature R' approximately equal to R minus the thickness of the end.

3. Overcap according to claim 1, wherein the arc of circle α extends from 55 to 80°.

4. Overcap according to claim 1, wherein the width L of the circular junction area (4) varies from 1 mm to 5 mm.

5. Overcap according to claim 1, wherein the thickness of the first strip of material (5) is greater than the thickness of the second strip of material (6).

6. Overcap according to claim 1, wherein the first strip of material (5) forming the top (2) is a metallic strip with a thickness of between 40 and 120 μm.

7. Overcap according to claim 1, wherein the first strip of material (5) forming the top (2) is a strip of metalloplastic material with an Al/PO/Al structure or an Al/PO structure, where PC denotes a polyolefin layer, and Al denotes a layer of aluminum or aluminum alloy, the thickness of the PO layer being between 10 and 80 μm, the thickness of the Al being between 10 and 60 μm, and the thickness of the strip being between 30 and 120 μm.

8. Overcap according to claim 1, in wherein the first strip of material (5) forming the top (2) is a plastic material strip with a thickness of between 40 and 200 μm.

9. Overcap according to claim 8, wherein the plastic material is a transparent plastic material.

10. Overcap according to claim 1, wherein the second strip of material (6) forming the skirt (3) is selected from the group consisting of metallic and metalloplastic materials that can be crimped or placed or folded down, and heat shrinkable plastics.

11. Overcap according to claim 10, wherein the metalloplastic material is a multi-layer material with the Al/PO/Al or Al/PO structure, wherein PO denotes a polyolefin layer, and Al denotes an aluminium or alloy layer.

12. Overcap according to claim 11, in wherein the PO layer bonds to the Al layer, either by using a PO layer comprising carboxylic acid or carboxylic anhydride functions, or a complementary adhesive layer between the PO and Al layers, or due to surface treatments of the PO and/or Al layers that improve this bond.

13. Overcap according to claim 11, wherein the PO layer has a thickness between 10 and 80 mμ and the Al layer has a thickness between 10 and 50 mμ and the total thickness of the corresponding multi-layer material is between 20 mμ and 100 mμ.

14. Overcap according to claim 1, wherein the rolled skirt (3) is a skirt made of crimpable or heat shrinkable material, so as to form an overcap (11) for receptacles containing still liquids (83).

15. Overcap according to claim 1, wherein the rolled skirt is a skirt made of a material that can be placed and folded down, in order to form an overcap (12) for receptacles containing liquids under pressure (84).

16. Overcap according to claim 1, additionally comprising easy opening means (35, 36).

17. Overcap according to claim 1, with a tapered skirt, to enable stacking of the overcaps, and fitted with a continuous or interrupted circular destacking ring (34) on the skirt, in order to check the stacking of the overcaps (1, 11) and to facilitate unstacking.

18. Overcap according to claim 1, wherein the skirt and cap are fixed by gluing.

19. Overcap according to claim 4, wherein the width L of the circular junction area (4) varies from 1 mm to 2 mm in the case of capsules for the packaging of still wines, and from 2 mm to 5 mm in the case of wines under pressure.

20. Overcap according to claim 6, wherein the first strip of material is aluminum or an aluminum alloy.

21. Overcap according to claim 8, wherein the plastic material strip is a polyolefin.

* * * * *